US005704071A

United States Patent [19]

Barclay et al.

[11] Patent Number: 5,704,071

[45] Date of Patent: Jan. 6, 1998

[54] ATHLETIC TRUNKS WITH OVERLAPPING LEG PANELS

[76] Inventors: Charles M. Barclay; Paula A. Barclay, both of Rte. 1, Box 594, Silsbee, Tex. 77656

[21] Appl. No.: 770,984

[22] Filed: Dec. 20, 1996

[51] Int. Cl.[6] ..... A41D 1/08

[52] U.S. Cl. ..... 2/238; 2/400

[58] Field of Search ..... 2/238, 212, 400, 2/404, 402, 407, 227, 228, 234, 213, 67

[56] References Cited

U.S. PATENT DOCUMENTS

| | | | |
|---|---|---|---|
| D. 230,538 | 3/1974 | Hansen | D2/34 |
| D. 266,540 | 10/1982 | Nacinovich | D2/42 |
| 1,747,562 | 2/1930 | Wellstatter | 2/212 |
| 1,966,060 | 7/1934 | Cohen | 2/400 |
| 2,091,441 | 8/1937 | Hauser | 2/212 |
| 2,310,367 | 2/1943 | Harwood . | |
| 2,431,571 | 11/1947 | Lehr | 2/238 |
| 2,580,774 | 1/1952 | Helbig | 2/212 |
| 2,613,363 | 10/1952 | Morgan | 2/212 |
| 2,617,112 | 11/1952 | Neilson . | |
| 2,893,015 | 7/1959 | Fox | 2/212 |
| 3,945,051 | 3/1976 | Burkard | 2/238 |
| 4,223,408 | 9/1980 | Sullivan | 2/238 |
| 4,602,388 | 7/1986 | Underwood et al. | 2/238 |

FOREIGN PATENT DOCUMENTS

| | | | |
|---|---|---|---|
| 1522492 | 4/1968 | France | 2/238 |
| 2157126 | 6/1973 | France | 2/212 |
| 121323 | 7/1927 | Switzerland | 2/212 |
| 23597 | of 1914 | United Kingdom | 2/212 |

*Primary Examiner*—Amy B. Vanatta
*Attorney, Agent, or Firm*—Stephen R. Greiner

[57] ABSTRACT

Athletic trunks having a pair of rear panels joined along common forward and rearward edges in a vertical plane and joined along their upper edges to the periphery of a waistband. A pair of front panels are joined together, and to the forward edge of the rear panels, along a common edge in the vertical plane. The front panels are joined along their lower edges to the lower edges of the rear panels. The front panels are also joined along their upper edges to the waistband so the front panels overlap the rear panels. The front panels are free of attachment to the rear panels over the portion of overlap remote from the waistband and the vertical plane.

15 Claims, 1 Drawing Sheet

FIG. 1
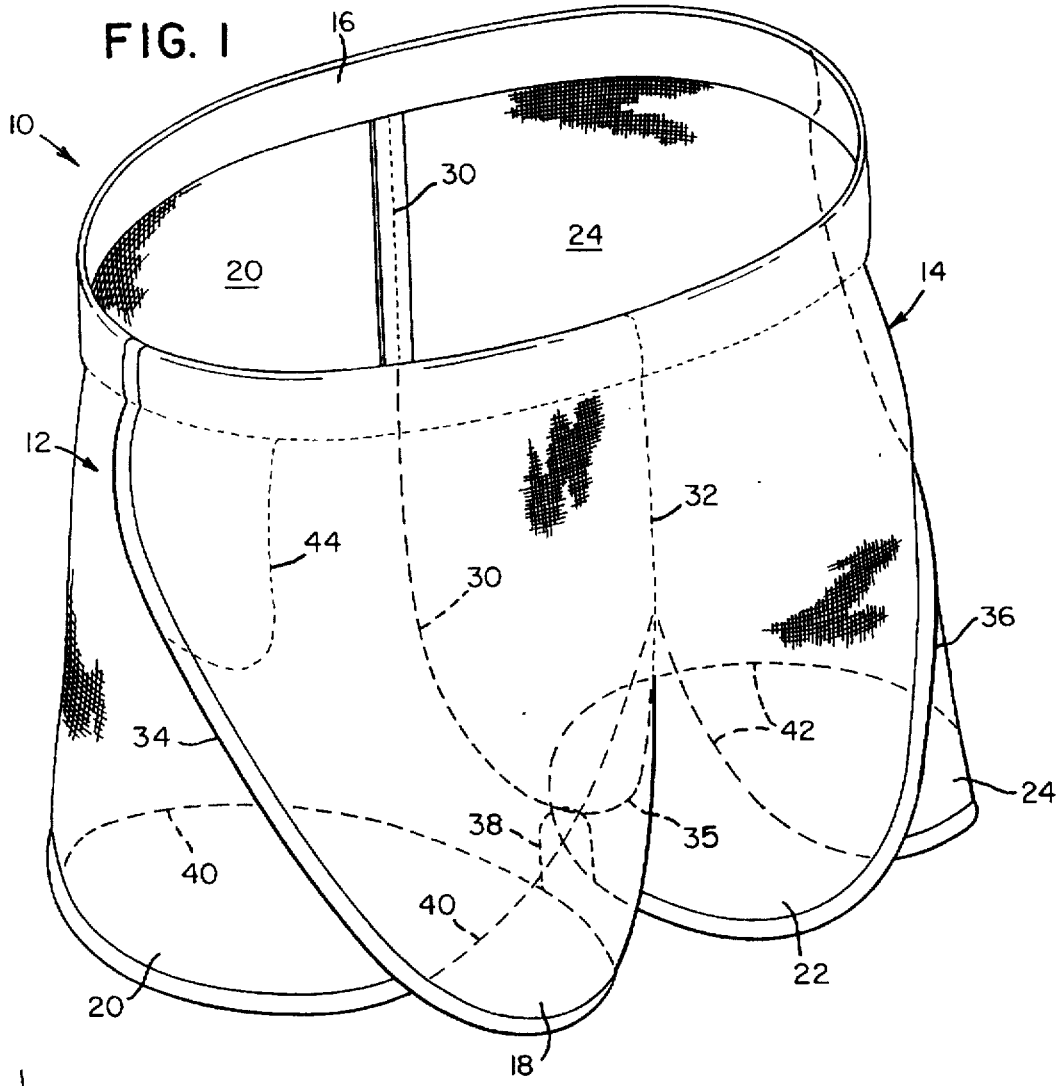
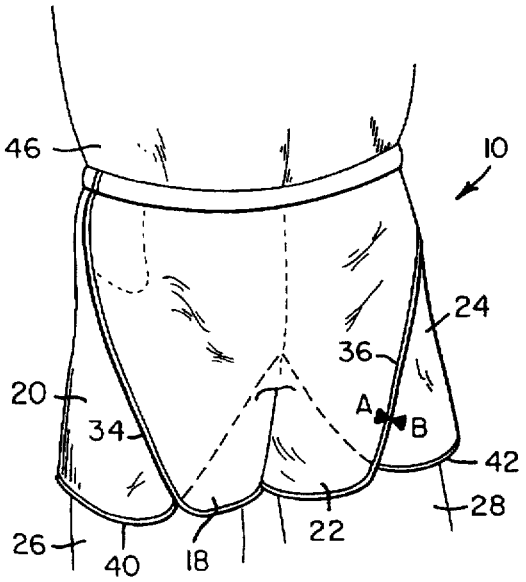
FIG. 2
FIG. 3
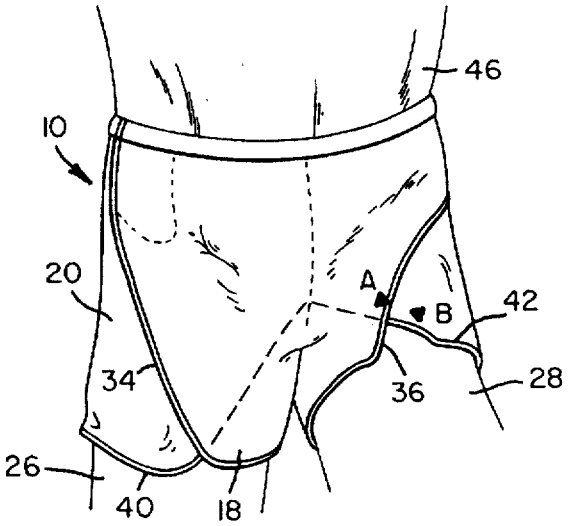

ATHLETIC TRUNKS WITH OVERLAPPING LEG PANELS

FIELD OF THE INVENTION

The present invention relates generally to articles of apparel and, in particular, to shorts or trunks.

BACKGROUND OF THE INVENTION

Short pants of varied design have been proposed in an effort to provide the maximum freedom of movement to a wearer. Now in widespread use are shorts whose leg portions have vertical slits in their respective sides to provide leg openings of variable dimensions. Unfortunately, these slits have a tendency to open during use and expose the upper thighs, groin, and buttocks of a wearer in an embarrassing manner.

SUMMARY OF THE INVENTION

In light of the problems associated with the prior art shorts, it is a principal object of the invention to provide athletic trunks which will cover the upper thighs, groin, and buttocks of a wearer at all times during use, yet will allow great freedom of movement to the wearer.

It is an object of the invention to provide improved elements and arrangements thereof in athletic trunks for the purposes described which are lightweight in construction, inexpensive in manufacture, and fully dependable in use.

Briefly, the athletic trunks in accordance with this invention achieve the intended objects by featuring a pair of rear panels joined along common forward and rearward edges in a vertical plane and joined along their upper edges to the periphery of a waistband. A pair of front panels are joined together, and to the forward edge of the rear panels, along a common edge in the vertical plane. The front panels are joined along their lower edges to the lower edges of the rear panels and joined along their upper edges to the waistband so as to overlap the rear panels. The front panels are free of attachment to the rear panels over the portion of overlap remote from the waistband and the vertical plane.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of athletic trunks with overlapping leg panels in accordance with the present invention.

FIG. 2 is a perspective view of the athletic trunks on a wearer who is standing normally.

FIG. 3 is a perspective view of the athletic shorts on a wearer with the wearer's left leg in an elevated position.

Similar reference characters denote corresponding features consistently throughout the accompanying drawings.

DETAILED DESCRIPTION OF THE PREFERRED EMBODIMENT

Referring now to the FIGS., athletic trunks in accordance with the present invention are shown at 10. The trunks 10 include right and left leg portions 12 and 14 secured together and to a circular waistband 16. The right leg portion 12 has a front panel 18 overlapping a rear panel 20. The left leg portion 14 is similarly configured with a front panel 22 overlapping a rear panel 24. When the wearer's legs 26 and 28 are moved, as is done while walking, the front panels 18 and 22 slide over the rear panels 20 and 24 to conform to the positioning of the wearer's legs.

The upper edges of the rear panels 20 and 24 are joined to the waistband 16 so as to extend around the full circumference of the waistband. The rearward edges of the rear panels 20 and 24 extend downwardly from the waistband 16 and are secured together by a rearward seam 30. The forward edges of the rear panels 20 and 24 also extend downwardly from the waistband 16 and are secured together by an upper forward seam 32. Preferably, the forward and rearward seams 30 and 32 are located directly opposite one another across the waistband 16.

The front panels 18 and 22 are secured along their upper edges to the waistband 16 so as to overlap a portion of the rear panels 20 and 24. The forward edges of the front panels 18 and 22 extend downwardly from the waistband 16 and are joined together by the upper forward seam 32 and a downward extension thereof, lower forward seam 35. The rearward edges 34 and 36 of the front panels 18 and 22, however, are positioned on the waistband 16 midway between the seams 30 and 32 so as to be located proximate the hips of a wearer. The lower edges of the front panels 18 and 22 are joined to the lower edges of the rear panels 20 and 24 with a crotch seam 38.

To enhance the comfort and flexibility of the trunks 10, the rearward edges 34 and 36 of the front panels 18 and 22 are each provided with a curved shape which arcs downwardly from the waistband 16 to the crotch seam 38. The bottom edges 40 and 42 of the rear panels 20 and 24, however, define opposed curves which arc upwardly from locations below the rearward edges 34 and 36 of the front panels 18 and 22 to the forward seam 32. Preferably, the rearward edges 34 and 36 of the front panels 18 and 22 and the bottom edges 40 and 42 of the rear panels 20 and 24 cross at a point about one-quarter of the distance along each of the rearward edges 34 and 36 from the crotch seam 38 to the waistband 16 so as to smoothly engage the middle of a thigh of the wearer.

Some wearers of the trunks 10 may find it advantageous to have a pocket therein for the storage of small objects. Such a pocket may be supplied by means of a generally U-shaped seam 44 securing, for example, the front and rear panels 18 and 20 together. Access to the pocket interior may be gained by simply lifting the rearward edge 34 of the front panel 18.

The functioning of the trunks 10 is illustrated in FIGS. 2 and 3. In FIG. 2, the trunks 10 are shown on an individual with legs 26 and 28 extending downwardly from the torso 46. To illustrate the relative movement of the front panel 22 and rear panel 24, marker "A" is shown on the rearward edge 36 of the front panel 22 abutting a marker "B" on the rear panel 24. In FIG. 3, the left leg 28 has been elevated causing the front panel 22 to flex and rotate over the rear panel 24 thereby separating markers "A" and "B". Since the rear panel 24 substantially encircles the leg 28, the groin or buttocks of the wearer are not exposed when the leg 28 is elevated.

While the invention has been described with a high degree of particularity, it will be appreciated by those skilled in the art that many modifications may be made thereto. For example, the rear panels 20 and 24, which preferably comprise relatively large pieces of fabric, may each be formed from two or more smaller pieces of fabric if desired. Therefore, it is to be understood that the present invention is not limited to the sole embodiment described above, but encompasses any and all embodiments within the scope of the following claims.

We claim:

1. Athletic trunks, comprising:

a waistband;

a pair of rear panels joined together along common forward and rearward edges in a vertical plane, said rear panels also being joined along their upper edges to the periphery of said waistband; and, a pair of front panels joined together, and to said forward edge of said rear panels, along a common edge in said vertical plane, said front panels being joined along their lower edges to the lower edges of said rear panels, said front panels also being joined along their upper edges to said waistband so that said front panels overlap said rear panels, and said front panels being free of attachment to said rear panels over the portion of overlap remote from said waistband and said vertical plane.

2. The athletic trunks according to claim 1 wherein said front panels have rearward edges attached to said waistband about midway between said forward and rearward edges of said rear panels so as to be positioned adjacent the hips of a wearer.

3. The athletic trunks according to claim 2 wherein said rearward edges of said front panels slope forwardly and downwardly from said waistband to said lower edges of said front panels.

4. The athletic trunks according to claim 1 wherein said lower edges of said front panels are joined together and extend beneath said common forward edge of said rear panels to join the lower edges of said rear panels to provide the trunks with a crotch portion.

5. The athletic trunks according to claim 1 wherein said front panels are positioned in front of said back panels at the portion of overlap therebetween.

6. The athletic trunks according to claim 3 wherein said rear panels have bottom edges which cross said rearward edges of said front panels at points substantially midway between said vertical plane and the opposed sides of said trunks so that the points of crossing engage the front of the thighs of a wearer.

7. Athletic trunks, comprising:

a waistband for encircling the waist of a wearer;

a pair of rear panels joined together along common forward and rearward edges in a vertical plane, said rear panels also being joined along their upper edges to the periphery of said waistband; and, a pair of front panels joined together, and to said forward edge of said rear panels, along a common edge in said vertical plane, said front panels being joined along their lower edges, which extend beneath said common forward edge of said rear panels, to the lower edges of said rear panels, said front panels also being joined along their upper edges to said waistband so that said front panels overlap said rear panels, and said front panels being free of attachment to said rear panels over the portion of overlap remote from said waistband and said vertical plane.

8. The athletic trunks according to claim 7 wherein said front panels have rearward edges attached to said waistband about midway between said forward and rearward edges of said rear panels so as to be positioned adjacent the hips of a wearer.

9. The athletic trunks according to claim 8 wherein said rearward edges of said front panels slope forwardly and downwardly from said waistband to said lower edges of said front panels so as to substantially parallel the crease at the junction of the thigh and torso of a wearer.

10. The athletic trunks according to claim 9 wherein said front panels are positioned in front of said back panels at the portion of overlap therebetween.

11. The athletic trunks according to claim 9 wherein said rear panels have bottom edges which cross said rearward edges of said front panels at points substantially midway between said vertical plane and the opposed sides of said trunks so that the points of crossing engage the front of the thighs of a wearer.

12. Athletic trunks, comprising:

a waistband for encircling the waist of a wearer;

a pair of rear panels joined together along common forward and rearward edges in a vertical plane, said rear panels also being joined along their upper edges to the periphery of said waistband; and, a pair of front panels joined together, and to said forward edge of said rear panels, along a common edge in said vertical plane, said front panels being joined along their lower edges, which extend beneath said common forward edge of said rear panels, to the lower edges of said rear panels, said front panels also being joined along their upper edges to said waistband so as to overlap said rear panels, said front panels having rearward edges joined to said waistband about midway between said forward and rearward edges of said rear panels, said rearward edges sloping forwardly and downwardly from said waistband to said lower edges of said front panels so as to substantially parallel the crease at the junction of the thigh and torso of a wearer.

13. The athletic trunks according to claim 12 further comprising a seam securing at least one of said front panels to an adjacent one of said rear panels to provide a pocket having an access opening formed partially by said rearward edge of said front panel bearing said seam.

14. The athletic trunks according to claim 12 wherein said front panels are free of attachment to said rear panels over the portion of overlap remote from said waistband and said vertical plane.

15. The athletic trunks of claim 12 wherein said rear panels have bottom edges which cross said rearward edges of said front panels at points substantially midway between said vertical plane and the opposed sides of said trunks so that the points of crossing engage the front of the thighs of a wearer.

* * * * *